United States Patent [19]

Kakimi et al.

[11] Patent Number: 4,520,091

[45] Date of Patent: May 28, 1985

[54] ENCAPSULATED ELECTROSTATOGRAPHIC TONER MATERIAL

[75] Inventors: Fujio Kakimi; Takeshi Mikami, both of Fujinomiya, Japan

[73] Assignee: Fuji Photo Film Co., Ltd., Tokyo, Japan

[21] Appl. No.: 592,863

[22] Filed: Mar. 23, 1984

[30] Foreign Application Priority Data

Mar. 23, 1983 [JP] Japan ..... 58-48419

[51] Int. Cl.[3] ..... G03G 9/08

[52] U.S. Cl. ..... 430/110; 430/109; 430/137; 430/138; 430/106.6; 428/402.2; 428/402.24

[58] Field of Search ..... 430/109, 110, 137, 138; 428/402.2, 402.24

[56] References Cited

U.S. PATENT DOCUMENTS

| | | | |
|---|---|---|---|
| 3,714,065 | 1/1973 | Kitajima et al. | 430/138 X |
| 4,016,099 | 4/1977 | Wellman et al. | 430/137 |
| 4,259,428 | 3/1981 | Tsuneda | 430/138 X |
| 4,439,510 | 3/1984 | McLoughlin | 430/138 X |

*Primary Examiner*—Roland E. Martin

*Attorney, Agent, or Firm*—Toren, McGeady, Stanger

[57] ABSTRACT

An encapsulated electrostatographic toner material comprising a core and a shell enclosing the core, in which said core comprises:

a colorant;

a polymer;

a solvent having a boiling point of not lower than 180° C. which is capable of dissolving the polymer of causing the polymer to swell; and an organic liquid having a boiling point in the range of 100° to 250° C. which is substantially incapable of dissolving the polymer or causing the polymer to swell.

6 Claims, No Drawings

ENCAPSULATED ELECTROSTATOGRAPHIC TONER MATERIAL

BACKGROUND OF THE INVENTION

1. Field of the Invention

This invention relates to an encapsulated electrostatographic toner material, and more particularly to an encapsulated electrostatographic toner material advantageously employable in a pressure fixing process.

2. Description of Prior Art

There is known an electrostatography which comprises a stage of developing a tone electrostatic latent image contained on a photoconductive or dielectric surface with a toner material containing a colorant and a fixing aid (i.e., binder) to produce a visible toner image, and a subsequent stage of transferring and fixing the visible toner image onto a surface of a support medium such as a paper sheet.

The development of the latent image to produce a visible toner image is carried out by the use of either a developing agent consisting of a combination of a toner material with carrier particles, or a developing agent consisting of a toner material only. The developing process utilizing the combination of a toner material with carrier particles is named "two component developing process", while the developing process utilizing only a toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither a heating procedure nor a solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is considered to be an advantageous fixing process inherently having a variety of preferable features.

However, the pressure fixing process also has certain inadvantageous features. For instance, the pressure fixing process generally shows poorer fixability than the heat fixing process does, whereby the toner image fixed onto a paper is apt to rub off easily. Further, the pressure fixing process requires very high pressure for the fixing operation, and such high pressure tends to break the cellulose fibers of the support medium such as paper sheet and also produces glossy surface on the support medium. Moreover, the pressing roller requires to have relatively greater size, because the roller necessarily imparts very high pressure to the toner image placed on the support medium. Accordingly, reduction of the size of a copying and duplicating machine cannot exceed a certain limit defined by the size of a pressing roller.

There has been previously proposed an encapsulated toner material which comprises toner particles enclosed with microcapsules, so as to overcome the above-described disadvantageous features of the pressure fixing process. The encapsulated toner material is generally prepared by enclosing a core material (containing a colorant such as carbon black) with a shell which is rupturable by the application of pressure in the developing stage. Thus prepared encapsulated toner material has various advantageous features; for instance, fixing of the encapsulated toner material does not require very high pressure but the fixability is high. Accordingly, the encapsulated toner material is viewed as suitable for the use in the pressure fixing process. However, the encapsulated toner materials proposed up to now appear unsatisfactory in practical use, because they fail to meet some of requirements required for providing smooth copying and duplicating operation and satisfactory toner image fixability and quality.

More in detail, it is required for the toner material for the use as a dry type developing agent in the electrostatography to have excellent powder characteristics (or, powder flowability) to provide high development quality, and to be free from staining the surface of a photosensitive material on which a latent image is to be formed.

Further, a toner material employed for the two component developing process is also required not to stain the surfaces of the carrier particles employed in combination. The toner material for the use as a developing agent in the pressure fixing process is furthermore required to be satisfactory in the fixability under pressure and not to undergo off-setting on the roller surface, that is, phenomenon that the toner adheres to the roller surface so as to stain it.

In summary, a toner material employed in the pressure fixing process ought to be at a high level in all characteristics such as powder characteristics (i.e., powder flowability), fixability onto a support medium (e.g., paper sheet) as well as preservability of the fixed image, resistance to the off-setting, and electron chargeability and/or electroconductivity depending on the system employed. The previously proposed encapsulated toner materials are unsatisfactory in some of these characteristics.

SUMMARY OF THE INVENTION

Accordingly, it is an object of the present invention to provide an encapsulated electrostatographic toner material which is improved particularly in fixability. The fixability means preservability of adhesion of the visible image of toner particles onto the support medium (e.g., paper sheet). More in detail, the fixing of the encapsulated toner is performed by passing a support medium carrying the toner image thereon through hard metal rollers to apply pressure onto the support medium, whereby the encapsulated toner is ruptured thereon and fixed. The heretofore known encapsulated toner material is not sufficient in the fixability, and the conventional toner is liable to easily rub off with a finger or other material such as a paper sheet to stain a portion other than the image portion. Such insufficient fixability of the conventional encapsulated toner material is one reason to disturb practical use of the encapsulated toner material in the pressure fixing process.

Another object of the present invention is to provide an encapsulated electrostatographic toner material which is improved in the off-setting, in addition to the improvement of the fixability. The off-setting means a phenomenon in which a portion of the core material and shell ruptured by the application of pressure, for instance, by passing the support medium carrying the toner image thereon through hard metal rollers adheres to the surface of the roller to stain the roller surface. Such phenomenon to stain the roller surface is another reason to disturb practical use of the encapsulated toner material in the pressure fixing process.

A further object of the invention is to provide an encapsulated electrostatographic toner material which is easily ruptured in the developing stage (i.e., pressure fixing stage) but is resistant to rupture in other stages in the electrostatographic duplicating process, in addition of the improvements of the fixability and off-setting.

There is provided by the present invention a encapsulated electrostatographic toner material comprising a core and a shell enclosing the core, in which said core comprises a colorant, a polymer, a solvent having a boiling point of not lower than 180° C. which is capable of dissolving the polymer or causing the polymer to swell, and an organic liquid having a boiling point in the range of 100° to 250° C. which is substantially incapable of dissolving the polymer or causing the polymer to swell.

DETAILED DESCRIPTION OF THE INVENTION

There is already known a process for the preparation of microcapsules which comprises forming shells around core materials containing colorant and binder serving as adhesion aid for the colorant to adhere against a support medium. The encapsulated toner of the invention can be prepared by known processes.

For instance, an interfacial polymerization method can be mentioned as a process employable for the preparation of the microcapsules of the invention. Examples of other processes employable for the preparation of the microcapsules include an inner polymerization method, a phase separation method, an outer polymerization method, a fusion-dispersion-cooling method, and a coacervation method.

The process for the preparation of microcapsules utilizable in the invention can be carried out by other processes than the above-described processes. These processes can be employed in combination.

As the materials forming the shell of microcapsules, a variety of materials are known. These known materials can be employed in the present invention. Examples of the shell-forming material include proteins such as gelatin and casein; plant gum such as gum arabic and sodium alginate; celluloses such as ethylcellulose and carboxymethylcellulose; condensated polymers such as polyamide, polyester, polyurethane, polyurea, polysulfonamide, polysulfanate, polycarbonate, amino resin, alkyd resin and silicone resin; copolymers such as maleic anhydride copolymer, acrylic acid copolymer and methacrylic acid copolymer; vinyl polymers such as polyvinyl chloride, polyethylene and polystrytene; curable resins such as epoly resin; and inorganic polymers. Examples of the polymer preferably employable as the shell material include a polyurethane resin, a polyurea resin and a polyamide resin.

Among the known encapsulating methods, the interfacial polymerization method comprising the following process is preferably employed for the preparation of the toner material of the invention.

In the first place, the following two substances are selected:

Substance (A) which as such is a hydrophobic liquid or a substance being soluble, miscible or well dispersable in a hydrophobic liquid; and Substance (B) which as such is a hydrophilic liquid or a substance being soluble, miscible or well dispersable in a hydrophilic liquid, which can react with Substance (A) to produce a polymerization reaction product insoluble in either the hydrophobic liquid or the hydrophilic liquid. Examples of the polymerization reaction product include a polyurethane resin, a polyamide resin, a polyester resin, a polysulfonamide resin, a polyurea resin, an epoxy resin, a polysulfanate resin and a polycarbonate resin.

In the second place, microdroplets of a hydrophobic liquid including substance (A) and the core material comprising a colorant, a binder, a non-ferromagnetic inorganic pigment (if desired), etc. are dispersed in a hydrophilic liquid such as water containing Substance (B).

The substance (A) is caused to react with Substance (B) to undergo an interfacial polymerization reaction in the dispersion by an appropriate procedure, for instance, by heating the dispersion. Thus, the shell of a polymerization reaction product of Substance (A) with Substance (B) (and/or water) is formed around the hydrophobic droplets to produce microcapsules comprising the core and the shell enclosing the core.

Examples of Substance (A) preferably employed for the preparation of the shell in the invention include compounds having isocyanete groups described below:

(1) Diisocyanete m-phenylene diisocyanate, p-phenylene diisocyanate, 2,6-tolylene diisocyanate, 2,4-tolylene diisocyanate, naphthalene 1,4-diisocyanate, diphenylmethane 4,4'-diisocyanate, 3,3'-dimethoxy-4,4'-biphenyl diisocyanate, 3,3'-dimethyldiphenylmethane, 4,4'-diisocyanate, xylylene 1,4-diisocyanate, xylylene 1,3-diisocyanate, 4,4'-diphenylpropane diisocyanate, trimethylene diisocyanate, hexamethylene diisocyanate, propylene 1,2-diisocyanate, butylene 1,2-diisocyanate, ethylidyne diisocyanate, cyclohexylene 1,2-diisocyanate, cyclohexylene 1,4-diisocyanate, p-phenylene diisocyanate, triphenylmethane diisocyanate;

(2) Triisocyanate 4,4',4''-triphenylmethane triisocyanate, polymethylenepolyphenyl triisocyanate, toluene-2,4,6-triisocyanate;

(3) Tetraisocyanate 4,4'-dimethyldiphenylmethane 2,2',5,5'-tetraisocyanate;

(4) Polyisocyanate prepolymer an addition product of hexamethylene diisocyanate and hexanetriol, an addition product of 2,4-tolylene diisocyanate and catechol, an addition product of 2,4-tolylene diisocyanate and hexanetriol, an addition product of 2,4-tolylene diisocyanate and trimethylolpropane, an addition product of xylylene diisocyanate and trimethylolpropane; and (5) Dithioisocyanate prepolymer tetramethylene diisothiocyanate, hexamethylene diisothiacyanate, p-phenylene diisothiocyanate, xylylene 1,4-diisothiocyanate, ethylidyndiisothiocyanate.

Examples of Substance (B) preferably employed for the preparation of the shell in the invention include compounds described below:

(1) Water;

(2) Polyol ethylene glycol, propylene glycol, 1,4-butanediol, 1,5-pentanediol, 1,6-heptanediol, 1,7-heptanediol, 1,8-octanediol, trimethylolpropane, hexanetriol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'-bis(4-hydroxyphenyl)butane, 2,2'-bis(4-hydroxyphenyl-)isopentane, 1,1'-bis(4-hydroxyphenyl)cyclopentane, 1,1'-bis(4-hydroxyphenyl)cyclohexane,-2 2,2'-bis(4-hydroxy-3-methylphenyl)propane, bis(2-hydroxyphenyl)-methane, xylylenediol, pentaerythritol, glycerol, sorbitol;

(3) Polyamine ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, an addition product of an epoxy compound and an amine compound; and (4) Piperazine piperazine, 2-methylpiperazine, 2,5-dimethylpiperazine.

By the use of these Substance (A) and Substance (B), a polyurethane resin or a polyurea resin is prepared.

In the present invention, the terms "polyurethane" and "polyurea" means to include polymers produced by polycondensation reaction between polyisocyanate and one or more of the counterpart compounds such as polyol, water, polyamine and piperazine. Accordingly, the term "polyurethane" means either a simple polyurethane comprising substantially urethane bondings only or a polymer comprising urethane bondings and a relatively small number of urea bondings. The term "polyurea" means either a simple polyurea comprising substantially urea bondings only or a polymer comprising urea bondings and a relatively small number of urethane bondings.

In the above-described combinations, Substance (A) can be replaced with an acid chloride, a sulfonyl chloride, or a bischloroformate to produce a shell of other resinous material such as a polyamide resin.

Examples of these compounds are as follows:

(1) Acid chloride oxazoyl chloride, succinoyl chloride, adipoyl chloride, sebacoyl chloride, phthaloyl chloride, isophthaloyl chloride, terephthaloyl chloride, fumaroyl chloride, 1,4-cyclohexanedicarbonyl chloride, polyesters containing acid chloride groups, polyamides containing acid chloride groups;

(2) Sulfonyl chloride 1,3-benzenedisulfonyl chloride, 1,4-benzenedisulfonyl chloride, 1,5-naphthalenedisulfonyl chloride, 2,7-naphthalenedisulfonyl chloride, 4,4'-biphenyldisulfonyl chloride, p,p'-oxybis(benzenesulfonyl chloride), 1,6-hexanedisulfonyl chloride;

(3) Bischloroformate ethylene bis(chloroformate), tetramethylene bis(chloroformate), hexamethylene bis(chloroformate), 2,2'-dimethyl-1,3-propane bis(chloroformate), p-phenylene bis(chloroformate).

In the preparation of the dispersion of hydrophobic micro-droplets containing Substance (A) and the core material, the hydrophobic liquid to be dispersed preferably contains a low-boiling solvent or a polar solvent. These solvents serve for accelerating formation of the shell which is a reaction product between Substance (A) and Substance (B). Examples of these solvents include methyl alcohol, ethyl alcohol, diethyl ether, tetrahydrofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

There is no limitation on the shell material, so far as the material is rupturable under pressure in the developing stage. Accordingly, materials other than those described hereinbefore can be likewise employed. Examples of these materials include homopolymers and copolymers of styrene or a substituted styrene such as polystyrene, poly(p-chlorostyrene), styrene-butadiene copolymer, styrene-acrylic acid copolymer, styrene-acrylic ester copolymer, styrene-methacrylic acid copolymer, styrene-methacrylic ester copolymer, styrene-maleic anhydride copolymer, and styrene-vinyl acetate copolymer; polyvinyltoluene resin, acrylic ester homopolymer, methacrylic ester homopolymer, xylene resin, methylvinyl ether-maleic anhydride resin, vinyl butyral resin, poly(vinyl alcohol) resin, and poly(vinylpyrrolidone).

The shell can be composed substantially of a complex layer. For instance, the shell can comprise two or more polymers selected from the group consisting of a polyurethane resin, a polyurea resin and a polyamide resin.

The encapsulated toner material whose shell is composed substantially of a complex layer comprising two or more polymers selected from the group consisting of a polyurethane resin, a polyurea resin and a polyamide resin can be produced as follows.

In a hydrophobic liquid comprising the aforementioned core material are dissolved an acid chloride and a polyisocyanate. This solution is then dispersed in an aqueous medium comprising a polyamine or piperazine and a dispersing agent to produce micro-droplets of the core material having an average diameter in the range from about 0.5 to about 1,000 microns in the aqueous medium.

The dispersion produced above is then neutralized or made weak alkaline by addition of an alkaline substance, and subsequently heated to a temperature between 40° and 90° C. Upon completion of these procedures, a complex layer consisting substantially of a polyamide resin and a polyurea resin in which the polyamide resin is a reaction product produced by reaction between the acid chloride and the polyamine, and the polyurea resin is a reaction product produced by reaction between the polyisocyanate and the polyamine, is formed around the droplet of the core material. Thus, the encapsulated particle having the complex layer shell is obtained.

If a polyol is further added to the hydrophobic liquid in the above-described procedure, there is produced around the droplet of the hydrophobic core material a complex layer shell consisting substantially of the polyamide resin and a polyurethane resin, in which the polyurethane resin is a reaction product of the polyisocyanate with the polyol.

In the latter procedure, a complex layer consisting substantially of the polyamide, polyurea and polyurethane resins can be produced, if the polyamide is introduced into the reaction system in an amount exceeding the amount required to react with the introduced acid chloride.

The shell of thus produced particle is, as described above, a complex layer shell. The term "complex layer shell" means to include a shell comprising a polymer mixture, as well as to include a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

The acid chloride can be replaced with a dicarboxylic acid or its acid anhydride. Examples of the dicarboxylic acid include adipic acid, sebacic acid, phthalic acid, terephthalic acid, fumaric acid, 1,4-cyclohexanedicarboxylic acid, and 4,4'-biphenyldicarboxylic acid. Examples of the acid anhydride include phthalic anhydride.

The core material contains a colorant for producing a visible image from the latent image. The colorant generally is a dye or a pigment, but a certain agent providing no directly visible image such as fluorescent substance can be employed as the colorant, if desired.

The colorant is generally selected from a variety of dyes, pigments and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative dye, that is generally called Diazo Yellow; and and red colorants such as Rhodamine B Lake, that is, a double salt of xanthine dye with phosphorus wolframate and molybdate, Carmine 6B belonging to Azo pigment, and a quinacridone derivative.

The combination of a polymer, a solvent having a boiling point of now lower than 180° C. which is capable of dissolving the polymer or causing the polymer to swell (referred to hereinafter as "dissolving solvent"), and an organic liquid having a boiling point in the range of 100° to 250° C. which is substantially incapable of dissolving the polymer or causing the polymer to swell (referred to hereinafter as "non-dissolving liquid") serves in the core to keep the colorant dispersed in the core, and further serves in the course of the fixing stage to fix the visible toner image onto a support medium such as a paper sheet.

Among the above-mentioned components of the core material, the non-dissolving liquid serves to decrease the viscosity of the core material so that the core material (including a colorant) can permeate the support medium and the non-dissolving solvent as such can evaporate at an appropriate rate to assist solidification of the fixed visible image. Accordingly, the non-dissolving liquid contained in the core of the toner material of the present invention, that is, an organic liquid having a boiling point in the range of 100° to 250° C. which is substantially incapable of dissolving the polymer or causing the polymer to swell, serves to remarkably enhance the fixability of the toner material.

It is known that the fixability of the visible toner image can be improved by use of a combination of a polymer and a volatile solvent having a low-boiling point contained in the core, by Japanese Patent Provisional Publication No. 56(1981)-144434. This art is based on a conception that the polymer and the volatile low boiling solvent adhere to a support medium under pressure and the polymer is then solidified upon evaporation of the low-boiling solvent to accelerate the fixing of the colorant. According to study of the present invention, however, the fixability provided by this art is not sufficient. Further, an odor inherently attached to the low-boiling solvent as well as inflammability of the low-boiling solvent are unfavorable not only in the process of the preparation of an encapsulated toner material but also in the duplicating process, from environmental or safety viewpoints. Furthermore, it is observed that the fixability of the toner material containing the low-boiling solvent decreases in the course of a long term storage, probably because the low-boiling solvent evaporates gradually through the shell.

In contrast to the case of employing the low-boiling solvent, a visible toner image formed by the toner material containing in the core the combination of a polymer, a solvent having a boiling point of not lower than 180° C. which is capable of dissolving the polymer or causing the polymer to swell, and an organic liquid having a boiling point in the range of 100° to 250° C. which is substantially incapable of dissolving the polymer or causing the polymer to swell shows satisfactory fixability to a support medium such as a paper sheet, the fixability is apparently enhanced as compared with the case of employing the aforementioned encapsulated toner material containing the combination of a polymer and a low-boiling solvent. Further, the toner image fixed to a support medium employing the toner material of the present invention is preserved for a long period very satisfactorily as compared with the latter case of employing the combination including a low-boiling solvent. Furthermore, the procedure relating to the toner material of the invention requires no specific care to odor or inflammation, because of unemployment of the low-boiling solvent.

Examples of the solvent having a boiling point not lower than 180° C. employable in the present invention include the following compounds:

(1) Phthalic acid esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl)phosphate, tributyl phosphate, trihexyl phosphate, trioctyl phosphate, trinonyl phosphate, tridecyl phosphate, trioleyl phosphate, tris(butoxyethyl)phosphate, tris(chloroethyl)phosphate, tris(dichloropropyl)phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphtharene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acids

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

For the purpose of the present invention, the dissolving solvent is preferably selected from phthalic acid esters, phosphoric acid esters, diarylalkanes and alkylnaphthalenes.

The non-dissolving liquid, that is, an organic liquid having a boiling point in the range of 100° to 250° C. which is substantially incapable of dissolving the polymer or causing the polymer to swell is preferably selected from the group consisting of aliphatic saturated hydrocarbon and organic liquid mixtures containing as main component an aliphatic saturated hydrocarbon.

The aliphatic saturated hydrocarbon generally is available and employed in various use in the form of a mixture of plural aliphatic saturated hydrocarbon distillates having a certain boiling point range. Examples of the aliphatic saturated hydrocarbon preferably employable as the non-dissolving liquid of the present invention include aliphatic saturated hydrocarbon mixtures having boiling point ranges (from initial boiling point to drying point) of 115°–142° C. (e.g., ISOPAR E, available from Exxon Chemicals), of 158°–177° C. (e.g., ISOPAR G), of 174°–189° C. (e.g., ISOPAR H), of 188°–210° C. (e.g., ISOPAR L, and of 207°–258° C. (e.g., ISOPAR M).

The non-dissolving liquid employed in the invention more preferably has a boiling point range of 140°–220° C.

In the present invention, there is no limitation on a ratio (ratio by weight) of the non-dissolving liquid to the dissolving solvent, but the ratio of the dissolving solvent/non-dissolving liquid preferably ranges from 9/1 to 1/9.

Examples of the polymer contained in the core include the following polymers:

polyolefin, olefin copolymer, polystyrene, styrene-butadiene copolymer, epoxy resin, polyester, natural and synthetic rubbers, poly(vinylpyrrolidone), polyamide, cumarone-indene copolymer, methyl vinyl ether-maleic anhydride copolymer, maleic acid-modified phenol resin, phenol-modified terpene resin, silicone resin, epoxy-modified phenol resin, amino resin, polyurethane elastomer, polyurea elastomer, homopolymer and copolymer of acrylic acid ester, homopolymer and copolymer of methacrylic acid ester, acrylic acid-long chain alkyl methacrylate copolymer oligomer, poly(vinyl acetate), and poly(vinyl chloride).

In the present invention, the polymer is preferably selected from the group consisting of homopolymers and copolymers of acrylic acid esters (acrylates), homopolymers and copolymers of methacrylic acid esters (methacrylates), and styrene-butadiene copolymers.

In the invention, each of the dissolving solvent, the non-dissolving liquid and a polymer can be employed alone or in combination.

There is no limitation on a ratio (ratio by weight) of the dissolving solvent+non-dissolving liquid to the polymer, but the ratio is preferably chosen within the range of 0.1–40, more preferably 0.2–10 (dissolving solvent+non-dissolving liquid per polymer).

The combination of the dissolving solvent, non-dissolving liquid, and polymer may form a highly viscous liquid depending on natures of these materials or the ratio of these materials. Such highly viscous liquid is rather difficultly emulsified in water in the initial stage of the encapsulation process. In such cases, the viscosity can be reduced by addition of a low-boiling solvent being sparingly miscible with water but substantially miscible with the dissolving solvent, non-dissolving liquid, and polymer, such as ethyl acetate or butyl acetate. Such low-boiling solvent can be removed upon completion of the emulsification, and then the encapsulation reaction is performed.

As described hereinbefore, the core of the encapsulated toner of the invention comprises a colorant, the dissolving solvent, the non-dissolving liquid and a polymer. Other additives such as a fluorine-containing resin being effective in prevention of the off-setting can be included. Also a magnetizable substance such as a metal, metal alloy, or metal compound of cobalt, iron, nickel or the like can be included for the preparation of the toner material, for instance, for the use in the one-component developing process.

The resinous shell of the encapsulated toner can be provided with a charge control agent such as a metal-containing dye or nigrosine, a flow improving agent such as hydrophobic silica, or other additive. These additive can be introduced into the shell of the encapsulated toner in an optional stage such as in the course of formation of the shell or after separating and drying the encapsulated toner.

The microcapsules prepared by forming shell around the above-mentioned core material are separated from the liquid phase (i.e., aqueous liquid medium) and then dried. The separating-drying procedure can be generally performed by spray-drying a dispersion containing the microcapsules.

The dried encapsulated toner is preferably heated to further improve its powder characteristics. The temperature for heating the dried encapsulated toner preferably ranges from 50° to 300° C., and more preferably ranges from 80° to 150° C. The period required for performing the heating varies with the heating temperature, the nature of the core material, etc. Generally, the period ranges from 10 minutes to 48 hours, and preferably ranges from 2 to 24 hours.

There is no limitation on the means employed for carrying out the heating procedure. Examples of the heating means include an electric furnace, a muffle furnace, a hot plate, an electric drying oven, a fluid bed drying apparatus, and a infrared drying apparatus.

The present invention will be illustrated by the following examples which are by no means intended to introduce any restriction into the invention.

EXAMPLE 1

In a liquid mixture (6:5, by weight) of 1-dimethylphenyl-1-phyenylethane and ISOPAR H (aliphatic saturated hydrocarbon mixture having a boiling point range of 174°-189° C., available from Exxon Chemicals) was dissolved polyisobutyl methacrylate in an amount to give a concentration of 40 wt.%. In 9 g. of the resulting mixture was dispersed 7 g. of magnetite particles (EPT-1000, available from Toda Kogyo Co., Ltd., Japan) to give a dispersion. The dispersion was then mixed with 6 g. of a solution of 1.6 g. of tolylene diisocyanate-hexanetriol 3:1 (molar ratio) addition product and 0.3 g. of terephthalic chloride in ethyl acetate (materials for the formation of shell) to prepare a primary liquid.

Independently, 40 g of 5% aqueous solution of polyvinyl alcohol (polymerization degree 500, saponification degree 98%) was prepared (a secondary liquid).

In the secondary liquid chilled to 10° C. was dropped the primary liquid, and the mixture was stirred by a high speed-rotation type homogenizer to give an oil-in-water emulsion having oily droplets of mean size approx. 14 μm.

To the resulting emulsion was added dropwise 3 g. of 10% aqueous diethylenetriamine solution. The mixture was adjusted to show pH 10 and stirred at 60° C. for 3 hours to complete encapsulating reaction.

Thus obtained aqueous microcapsule dispersion was subjected to centrifugal separation (5000 rpm) to separate the microcapsules from water. The separated microcapsules were then dispersed in water. The resulting dispersion was again subjected to centrifugal separation and the separated microcapsules were again dispersed in water in the same manner as above. Thus, the polyvinyl alcohol was removed from the liquid phase.

The microcapsule slurry was spray-dried under the conditions that the entrance temperature was 170° C., the exit temperature was 110° C., and the atomizing pressure was 2 kg/cm$^2$ to obtain a powdery encapsulated toner.

Microscopic observation indicated that the above-obtained powder toner showed high flowability and that most of the toner particles were present independently from each other without being agglomerated.

The fixability of the encapsulated toner was evaluated in the following manner.

A latent image prepared by the conventional electrostatography was developed using the above-obtained encapsulated toner to form a toner image, and the toner image was then transferred on a paper sheet to produce a visible image thereon. The visible image was fixed to the paper by means of a pressing roller at a pressure of 350 kg/cm$^2$. There was produced a highly sharp image. Further, almost no adhesion of the toner to the roller was observed. No mal odor was was produced in the above duplicating process. The visible image fixed onto the paper sheet was tried to rub off with a finger, but no removal of the toner was observed and the visible image was not stained.

COMPARISON EXAMPLE 1

The procedures of encapsulation, washing with water, and spray-drying described in Example 1 were repeated except that the mixture of 1-dimethylphenyl-1-phenylethane and ISOPAR H was replaced with toluene and that the toluene solution containing 40% polyisobutyl methacrylate was employed. Thus, a powdery encapsulated toner was obtained.

The same evaluation of the fixability described in Example 1 was applied to the above-obtained powder toner through transferring onto a paper sheet and fixing under pressure thereon. In the initial stage of the fixing procedure, mal odor originating from toluene was noted. Further, the visible image fixed to the paper sheet was tried to rub off, resulting in removal of a portion of the visible image and staining the image.

EXAMPLE 2

The procedures of encapsulation, washing with water, and spray-drying described in Example 1 were repeated except that the mixture of 1-dimethylphenyl-1-phenylethane and ISOPAR H was replaced with the same amount of a mixture (6:5, by weight) of 1-dimethylphenyl-1-phenylethane and ISOPAR G (aliphatic saturated hydrocarbon mixture having a boiling point range of 158°-177° C., available from Exxon Chemicals). Thus, a powdery encapsulated toner was obtained.

The same evaluation of the fixability described in Example 1 was applied to the above-obtained powder toner through transferring onto a paper sheet and fixing under pressure thereon. There was produced a highly sharp image. Further, almost no adhesion of the toner to the roller was observed. No mal odor was was produced in the above duplicating process. The visible image fixed to the paper sheet was tried to rub off with a finger, but no removal of the toner was observed and the visible image was not stained.

COMPARISON EXAMPLE 2

The procedures of encapsulation, washing with water, and spray-drying described in Example 2 were repeated except that the mixture of 1-dimethylphenyl-1-phenylethane and ISOPAR H was replaced with xylene and that the xylene solution containing 40% polyisobutyl methacrylate was employed. Thus, a powdery encapsulated toner was obtained.

The same evaluation of the fixability described in Example 1 was applied to the above-obtained powder toner through transferring onto a paper sheet and fixing under pressure thereon. In the initial stage of the fixing procedure, mal odor originating from xylene was noted. Further, the visible image fixed to the paper sheet was tried to rub off, resulting in removal of a portion of the visible image and staining the image.

EXAMPLE 3

In a liquid mixture (6:5, by weight) of 1-dimethylphenyl-1-phyenylethane and ISOPAR L (aliphatic saturated hydrocarbon mixture having a boiling point range of 188°-210° C., available from Exxon Chemicals) was dissolved styrene-butadiene copolymer in an amount to give a concentration of 40 wt.%. In 9 g. of the resulting mixture was dispersed 7 g. of magnetite particles (EPT-1000) to give a dispersion.

The subsequent procedures of encapsulation, washing with water, and spray-drying described in Example 1 were then repeated. Thus, a powdery encapsulated toner was obtained.

The same evaluation of the fixability described in Example 1 was applied to the above-obtained powder toner through transferring onto a paper sheet and fixing under pressure thereon. There was produced a highly sharp image. Further, almost no adhesion of the toner to the roller was observed. No mal odor was produced in the above duplicating process. The visible image fixed to the paper sheet was tried to rub off with a finger, but no removal of the toner was observed and the visible image was not stained.

Further, the satisfactory fixation of the visible image to the paper sheet was kept with no noticeable change after lapse of one month.

COMPARISON EXAMPLE 3

The procedures of encapsulation, washing with water, and spray-drying described in Example 3 were repeated except that the mixture of 1-dimethylphenyl-1-phenylethane and ISOPAR L was replaced with ethyl acetate and that the ethyl acetate solution containing 10% styrene-butadiene copolymer was employed. Thus, a powdery encapsulated toner was obtained.

The same evaluation of the fixability described in Example 1 was applied to the above-obtained powder toner through transferring onto a paper sheet and fixing under pressure thereon. In the initial stage of the fixing procedure, an odor originating from ethyl acetate was noted. Further, the visible image fixed to the paper sheet was tried to rub off, resulting in removal of a portion of the visible image and staining the image. The odor from the paper sheet having the fixed visible image diminished after lapse of one month, but the fixation was reduced at the same time.

We claim:

1. An encapsulated electrostatographic toner material comprising a core and a shell enclosing the core, in which said core comprises a colorant, a polymer, a solvent having a boiling point of not lower than 180° C. which is capable of dissolving the polymer or causing the polymer to swell, and an organic liquid having a boiling point in the range of 100° to 250° C. which is substantially incapable of dissolving the polymer or causing the polymer to swell.

2. The encapsulated electrostatographic toner material as claimed in claim 1, in which said polymer is selected from the group consisting of homopolymers and copolymers of acrylic acid esters, homopolymers and copolymers of methacrylic acid esters, and styrene-butadiene copolymer.

3. The encapsulated electrostatographic toner material as claimed in claim 1, in which the solvent having a boiling point of not lower than 180° C. is selected from the group consisting of phthalic acid esters, phosphoric acid esters, alkylnaphthalenes, and diarylalkanes.

4. The encapsulated electrostatographic toner material as claimed in claim 1, in which said organic liquid having a boiling point in the range of 100° to 250° C. is selected from the group consisting of aliphatic saturated hydrocarbon and organic liquid mixtures containing as main component an aliphatic saturated hydrocarbon.

5. The encapsulated electrostatographic toner material as claimed in any one of claims 1 to 4, in which said shell comprises at least one resin selected from the group consisting of a polyurethane resin, a polyurea resin and a polyamide resin.

6. The encapsulated electrostatographic toner material as claimed in any one of claims 1 to 4, in which said shell is composed of a complex layer comprising at least two resins selected from the group consisting of a polyurethane resin, a polyurea resin and a polyamide resin.

* * * * *